US011245208B2

(12) United States Patent
Liu et al.

(10) Patent No.: US 11,245,208 B2
(45) Date of Patent: Feb. 8, 2022

(54) CARD EDGE CONNECTOR WITH IMPROVED GUIDING STRUCTURE

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Xiao-Tong Liu, Kunshan (CN); De-Jin Chen, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/852,572

(22) Filed: Apr. 20, 2020

(65) Prior Publication Data

US 2020/0335890 A1 Oct. 22, 2020

(30) Foreign Application Priority Data

Apr. 18, 2019 (CN) ..... 201910311341.3

(51) Int. Cl.
*H01R 12/72* (2011.01)
*H01R 12/70* (2011.01)

(52) U.S. Cl.
CPC ..... *H01R 12/7064* (2013.01); *H01R 12/7023* (2013.01); *H01R 12/721* (2013.01)

(58) Field of Classification Search
CPC ..... H01R 12/7064; H01R 12/7023; H01R 12/721; H01R 13/405; H01R 13/514; H01R 13/631; H01R 12/716; H01R 13/502; H01R 12/737
See application file for complete search history.

(56) References Cited

U.S. PATENT DOCUMENTS

| | | | | |
|---|---|---|---|---|
| 6,017,248 | A | 1/2000 | Pan et al. | |
| 6,227,898 | B1 * | 5/2001 | Meng | H01R 13/645 439/374 |
| 6,439,901 | B1 | 8/2002 | Ji et al. | |
| 7,114,963 | B2 | 10/2006 | Shuey et al. | |
| 7,503,796 | B2 * | 3/2009 | Luettermann | H01R 13/631 439/377 |

(Continued)

*Primary Examiner* — Truc T Nguyen
(74) *Attorney, Agent, or Firm* — Ming Chieh Chang; Wei Te Chung

(57) ABSTRACT

A card edge connector includes an insulative housing defining a card receiving slot extending along a longitudinal direction, a plurality of terminals retained in the housing and by two sides of the card receiving slot in a transverse direction perpendicular to the longitudinal direction, and a metallic guiding member retained to the housing at the end of the card receiving slot. The metallic guiding member includes a main body extending in a vertical direction perpendicular to both the longitudinal direction and the transverse direction, and a curved resilient guiding section upwardly extending from a top end of the main body. The housing forms a constraining wall at the end with a step structure so as to allow the guiding section of the guiding member to be freely support upon the step structure to function as a constrained beam during confrontation with the inserted card module.

20 Claims, 7 Drawing Sheets

(56) References Cited

U.S. PATENT DOCUMENTS

| | | | | |
|---|---|---|---|---|
| 7,699,644 | B2 | 4/2010 | Szczesny et al. | |
| 7,985,087 | B2 * | 7/2011 | Li | H01R 12/7029 439/157 |
| 2007/0155245 | A1 | 7/2007 | Tsai | |
| 2008/0176451 | A1 * | 7/2008 | Li | H01R 12/721 439/633 |
| 2008/0220642 | A1 * | 9/2008 | Guan | H01R 12/721 439/325 |
| 2009/0088003 | A1 * | 4/2009 | Szczesny | H01R 12/7005 439/62 |
| 2011/0076868 | A1 * | 3/2011 | Yao | H01R 12/721 439/153 |
| 2013/0059455 | A1 * | 3/2013 | Li | H01R 12/7005 439/157 |
| 2014/0377972 | A1 * | 12/2014 | Tang | H01R 12/721 439/157 |
| 2019/0006778 | A1 * | 1/2019 | Fan | H01R 12/716 |

* cited by examiner

CARD EDGE CONNECTOR WITH IMPROVED GUIDING STRUCTURE

BACKGROUND OF THE INVENTION

1. Field of the Invention

The present invention relates to a card edge connector, especially to a guiding structure of the card edge connector.

2. Description of Related Arts

U.S. Pat. No. 7,699,644 discloses a card edge connector. The card edge connector includes an insulative housing, a plurality of terminals retained in the housing, a metallic reinforcement piece located at a metal reinforcement piece retained to an end of the housing at the end of the card receiving slot for confronting the card module which is downwardly assembled into the card receiving slot. Understandably, the metal guiding piece is to protect the housing during insertion of the card module into the card receiving slot. Anyhow, because the metal guiding piece is immovably attached upon the housing without any deformation space, the reaction force derived form the guiding piece during any improper insertion of the card module may be applied to the card module to damage the card module.

Therefore, it is desired to provide a new card edge connector with the improved metal guiding piece having some degrees of deformation during insertion of the card module into the card receiving slot, thus avoiding damaging the inserted card module.

SUMMARY OF THE INVENTION

To achieve the above desire, a card edge connector includes an insulative housing defining a card receiving slot extending along a longitudinal direction, a plurality of terminals retained in the housing and by two sides of the card receiving slot in a transverse direction perpendicular to the longitudinal direction, and a metallic guiding member retained to the housing at the end of the card receiving slot. The metallic guiding member includes a main body extending in a vertical direction perpendicular to both the longitudinal direction and the transverse direction, and a curved resilient guiding section upwardly extending from a top end of the main body. The housing forms a constraining wall at the end with a step structure so as to allow the guiding section of the guiding member to be freely support upon the step structure to function as a constrained beam during confrontation with the inserted card module. Under such a situation, the end wall of the housing is protected by the metallic guiding member, and the inserted card module is not imposed excessive reaction forces during insertion.

DETAILED DESCRIPTION OF THE PREFERRED EMBODIMENT

Figure 1:
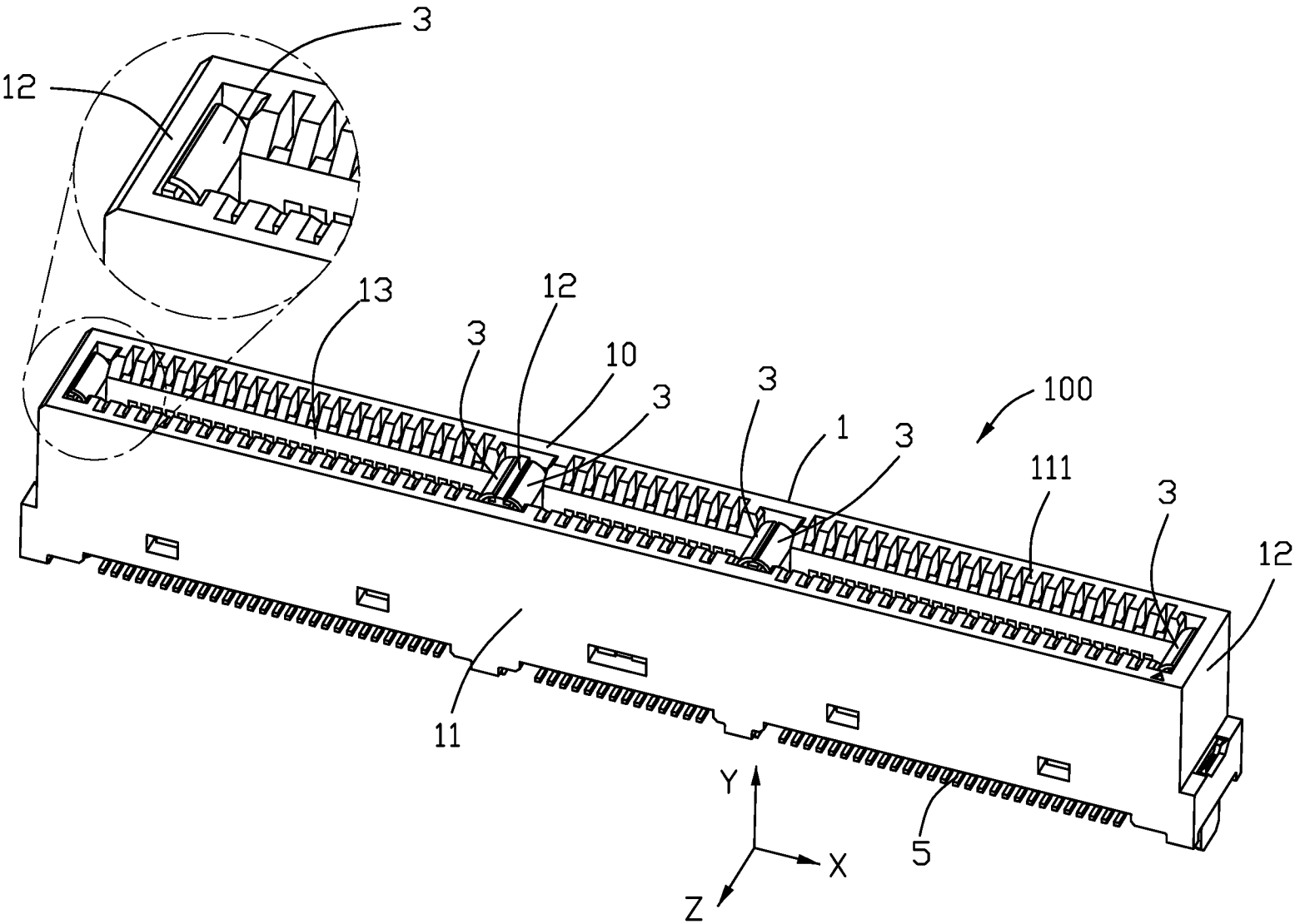
FIG. 1 is a perspective view of a card edge connector of an embodiment of this present invention.
Figure 2:
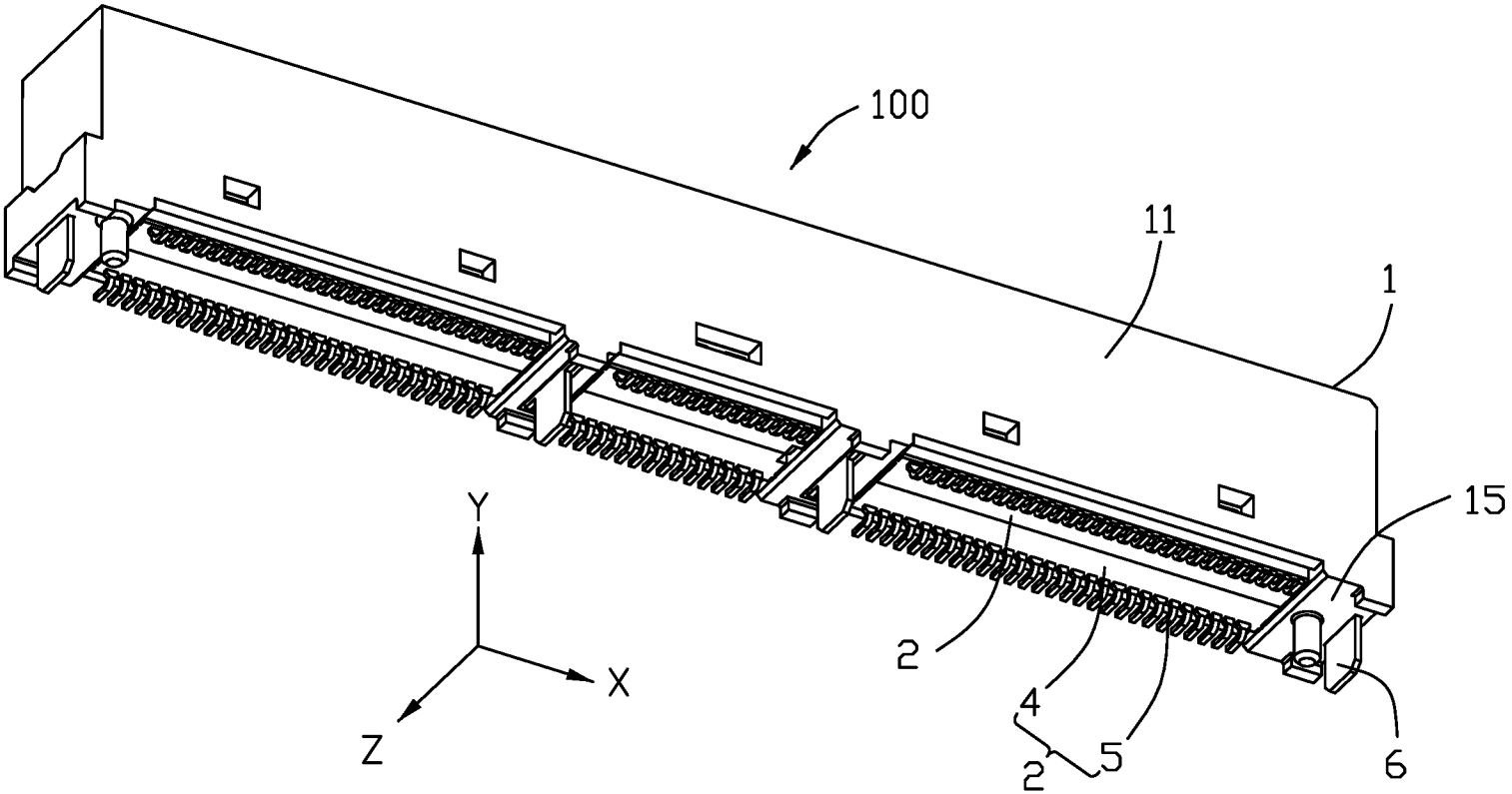
FIG. 2 is another perspective view of the card edge connector of FIG. 1.
Figure 3:
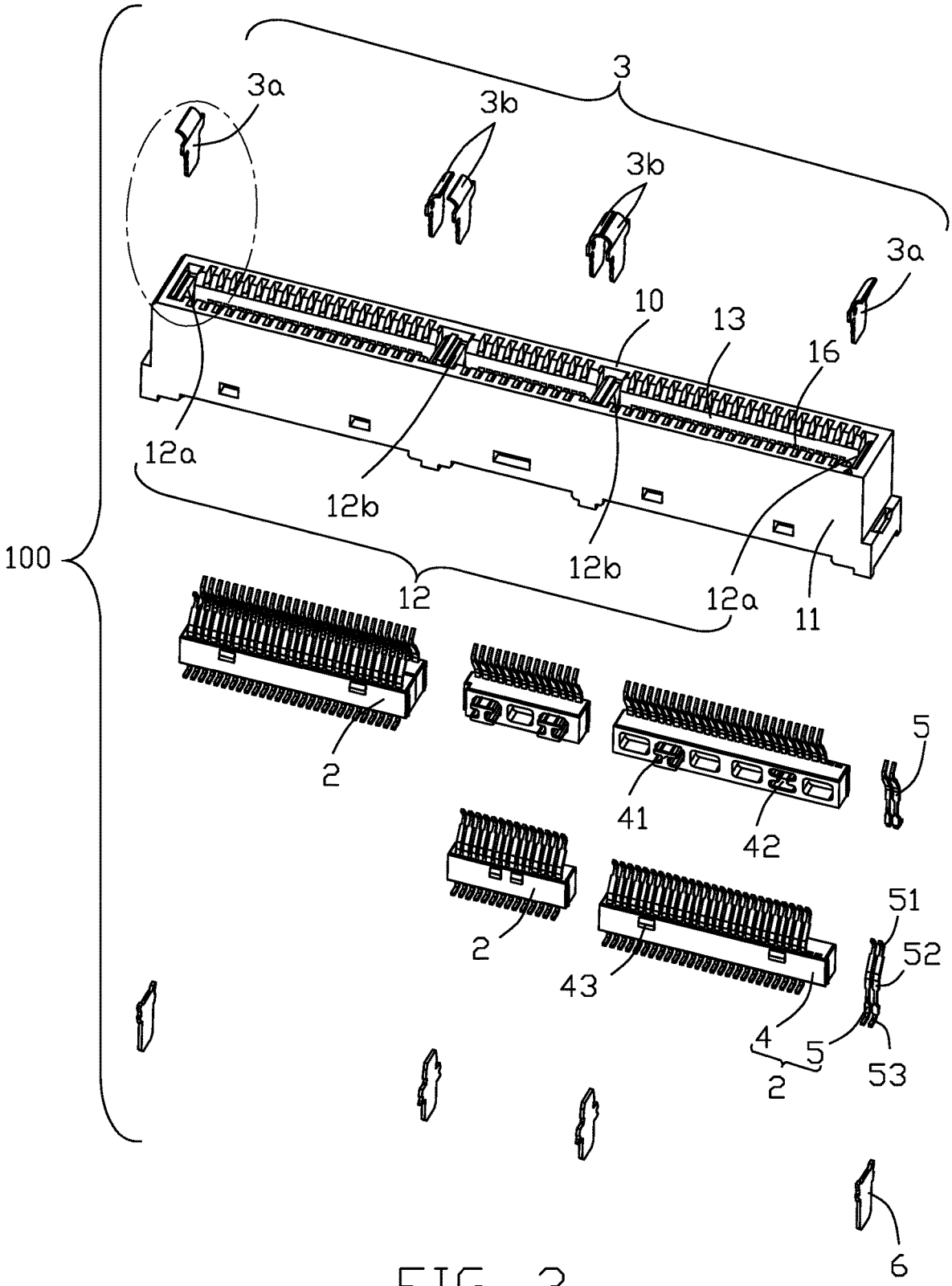
FIG. 3 is an exploded perspective view of the card edge connector of FIG. 2.
Figure 4:
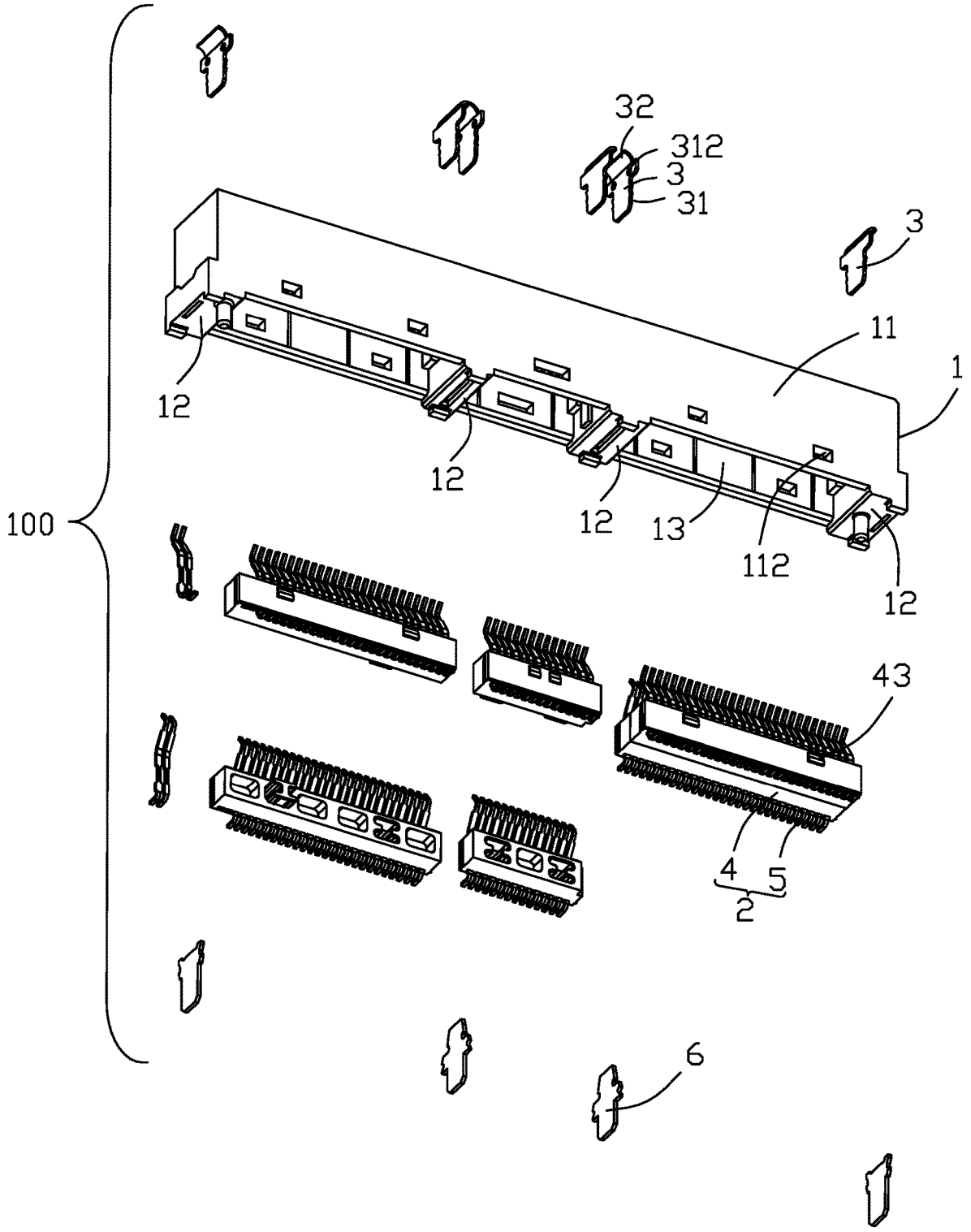
FIG. 4 is another exploded perspective view of the card edge connector of FIG. 3.
Figure 5:
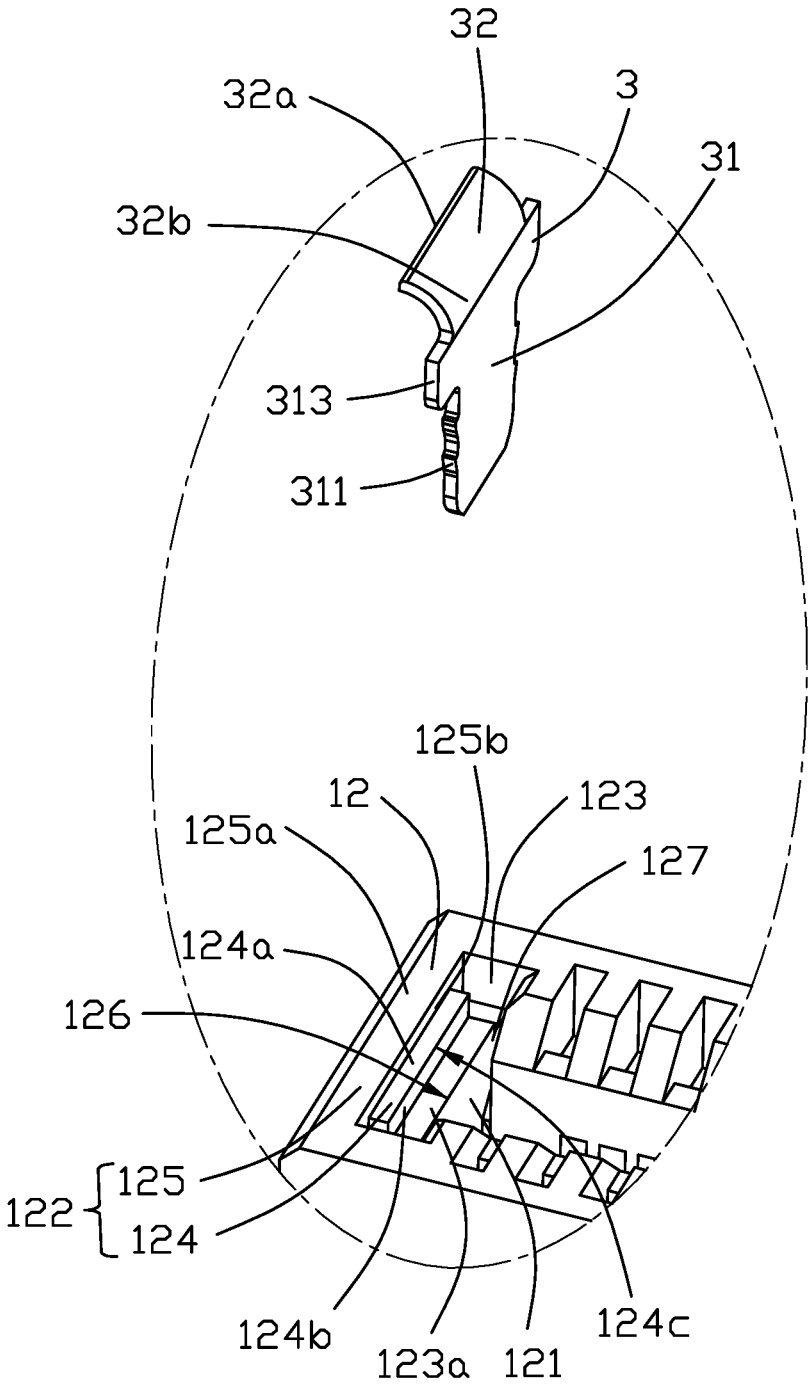
FIG. 5 is an enlarged exploded perspective view of an end portion of the card edge connector of FIG. 1.
Figure 6:
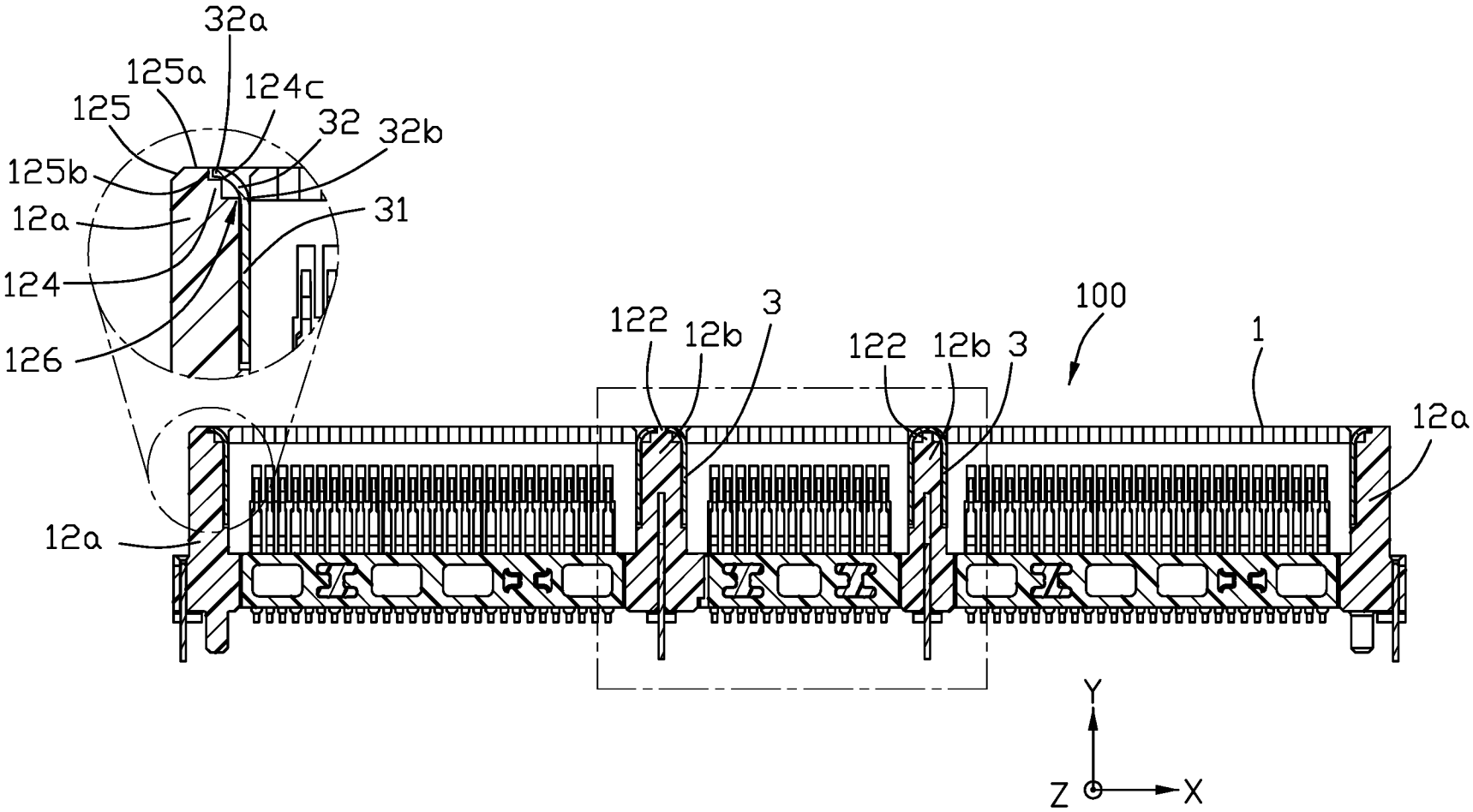
FIG. 6 is a cross-sectional view of the card edge connector of FIG. 1.
Figure 7:
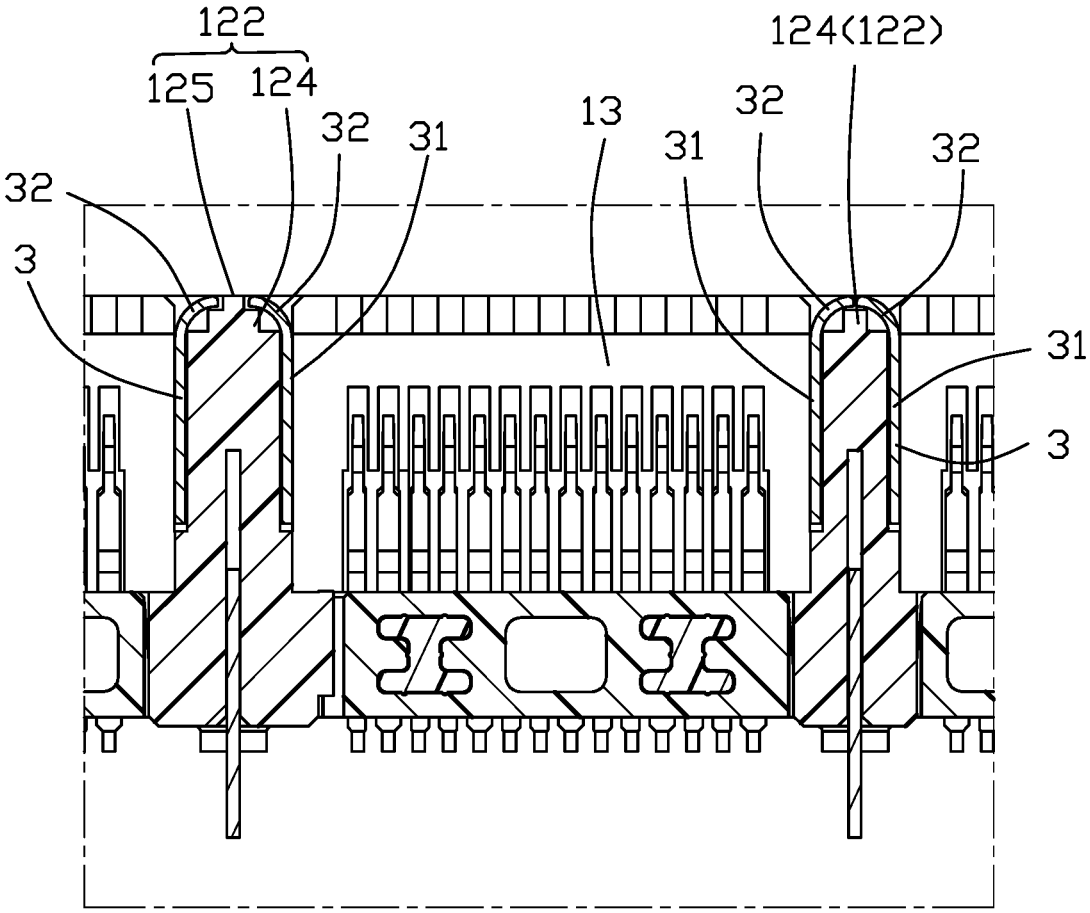
FIG. 7 is an enlarged cross-sectional view of a portion of the card edge connector of FIG. 6.

Referring to FIGS. 1-2, a card edge connector 100 for mounting upon a printed circuit board (not shown) and receiving a card module (not shown) therein, includes an elongated insulative housing 1, a plurality of contact modules 2 assembled into the housing 1, and a plurality of metallic guiding members 3 retained in the housing 1. The contact module 2 includes a plurality of contacts 5 integrally formed within an insulator 4 via insert-molding.

The insulative housing 1 forms an upward mating face 1, a pair of opposite side walls 11 extending along the longitudinal direction X, two opposite end/constraining walls 12 linked to two opposite ends of the pair of side walls 11 in the transverse direction Z perpendicular to the longitudinal direction X, and a card receiving slot 13 formed among the pair of side walls 11 and the pair of end walls 12 and extending along the longitudinal direction X and upwardly communicating with an exterior in a vertical direction Y. Each side wall 11 forms a plurality of passageways 16 to receive the corresponding contacts 5, respectively, and communicate with the card receiving slot 13 in the transverse direction Z. The card module is adapted to be inserted into the card receiving slot 13 via the mating face 10 in the vertical direction Y. A plurality of ribs 111 are formed on the mating face 10 alternately arranged with the corresponding passageways 16. The constraining walls 12 include two opposite end walls 12*a* and two inner/key walls 12*b* wherein the two inner/key walls 12*b* are adapted to be received within corresponding notches in the bottom edge or gold finger region of card module. In this embodiment, the two inner walls 12*b* have different dimensions in the longitudinal direction X for compliant receipt within the corresponding notches in the card module. Notably, this differently sized feature is to assure only one orientation of the card module is adapted to be inserted into the card receiving slot 13. The constraining wall 12 forms a constraining face 121 facing toward the card receiving slot 13, and a step structure 122.

The metal guiding member 3 includes two first metal pieces 3*a* and two second metal pieces 3*b*. Each second metal piece 3*b* is assembled upon both sides the corresponding inner wall 12*b* in the longitudinal direction X. Understandably, the guiding member 3 is to protect the corresponding constraining wall 12 during insertion of the card module into the card receiving slot 13. In this embodiment, the second metal piece 3*b* is composed of two identical parts each is same with the first metal piece 3*a*, thus being able to share the same mold for manufacturing for saving the cost.

Each metal guiding member 3 includes a main body 31 and a curved resilient guiding section 32. In this embodiment, the resilient guiding section 32 curvedly extends while maybe extending angularly and obliquely. The main body 31 abuts against the constraining face 121 and exposed toward the card receiving slot 13, and the guiding section 32 abuts against the step structure so as to result in a constraining beam operation from the mechanical viewpoint. Notably, during insertion of the card module, the guiding section may be deformed due to the space formed by the step structure 122 so as not to form an improper interference when the card module is not precisely downwardly inserted into the card receiving slot 13 in the vertical direction. Understandably, the bottom end of the guiding section 32 is linked and supported by the main body 31, and the top end of the guiding section 32 abuts against the step structure 122 so as to form the so-called constraining beam from the mechanical viewpoint.

The constraining wall 12 forms a recess 123 under the mating face 10, and a slit 127 communicating with the recess 123 along the vertical direction Y, and with the card receiving slot 13 in the longitudinal direction X. The step structure 122 includes a first step 124 in the recess 123 above the bottom face 123*a* of the recess 123. The first step 124 includes a first surface 124*a*, the second surface 124*b* and a first shoulder edge 124*c* between the first surface 124*a* and the second surface 124*b*. In this embodiment, the guiding section 32 extends into the recess 123 with a free end 32*a* abutting against the firs shoulder edge 124*c*. The first surface 124*a* is located under the mating face 10 in a parallel relation while the second surface 124*b* is parallel to the constraining face 121. A second shoulder edge 126 is formed between the bottom face 123*a* of the recess 123 and the constraining face 121, and the other/connecting end 32*b* of the guiding section 32, which is linked to the main body 31, abuts against the second shoulder edge 126.

The step structure 122 further includes a second step 125 extending above the first step 124. The second step 125 includes a third surface 125*b* parallel to the first surface 124*a*, and a fourth surface 125*b* parallel to the second surface 124*b*. the third surface 125*a* is coplanar with the mating face 10, The free end 32*a* confronts the fourth surface 125*b* in the longitudinal direction. One inner wall 12*b* lacks the second step 125 so as to have the free ends 32*a* of the pair of second metal piece 3*b* abut against each other rather than against the fourth surface 125*b* of the second step 125.

The main body 31 is receive within the slit 127 with barbs 311 interfering within the slit 127 for retaining the main body 31 thereto. A pair of ears 313 are formed on two opposite lateral sides of the main body 31 to downwardly abut against the corresponding shoulder structure of the housing as a stopper in the vertical direction. A pair of embossments 312 are formed on an inner surface main body 31 for enhancing engagement between the main body 31 and the constraining face 121.

The housing 1 further includes a mounting face 15 opposite to the mating face 10. The constraining wall 12 extends between the mounting face 15 and the mating face 10. The contact module 2 is upwardly assembled into the housing 1 with the contacts 5 disposed in the corresponding passageways 16, respectively.

In detail, the insulators 4 of the contact modules 2 form a plurality of engagement blocks 41 and the engagement cavities 42 for assembling the paired contact modules 2 in the transverse direction Z. The side wall 11 forms a plurality of through holes 112 to receive the corresponding protrusions 43 on the insulator 4. The contact 5 includes a contacting section 51 extending into the card receiving slot 13, a retaining section 52 retained to the insulator 4, and a tail section 53 extending beyond the mounting face 15. A plurality of board locks 6 are retained to the corresponding constraining walls 12, respectively, from the mounting face 15.

Compared with the prior art, the invention provides a step structure with an internal space so as to have the curved guiding section 32 deformable when confronting the inserted card module, wherein the free end 32*a* abuts against the first shoulder edge 124*c* and the connecting end 32*b* abuts against the second shoulder edge 126. Under such a resilient operation, there will be no damage to either the housing nor the card module even if in a harsh insertion.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. A card edge connector comprising:

an insulative housing having a pair of side walls with a card receiving slot located therebetween in a transverse direction and extending along a longitudinal direction perpendicular to the transverse direction and communicating with an exterior in a vertical direction perpendicular to both the transverse direction and the longitudinal direction, and a plurality of constraining walls linked between the pair of side walls in the transverse direction, each constraining wall forming a step structure at a top end thereof and a vertically extending constraining face facing toward the card receiving slot;

a plurality of contacts disposed in the housing with contacting sections extending into the card receiving slot; and a plurality of metallic guiding members associating with the corresponding constraining walls, respectively; wherein each guiding member includes a planar main body attached upon the vertically extending constraining face, and a curved resilient guiding section unitarily extending from an upper end of the main body with a free end region intimately positioned, in the vertical direction, upon a shoulder edge formed on the step structure so as to have the guiding section deformable in a space between the step structure and the vertically extending constraining face.

2. The card edge connector as claimed in claim 1, wherein the step structure includes two steps, and the shoulder edge is formed by the step located at a lower level than the other.

3. The card edge connector as claimed in claim 2, wherein the step located at an upper level further forms a vertical surface above the shoulder edge, and a tip of the free end region of the guiding member intimately confronts the vertical surface along the longitudinal direction.

4. The card edge connector as claimed in claim 1, wherein the main body of the guiding member includes a pair of wings on two lateral edges and neighboring the curved resilient guiding section, and barbs on said two lateral edges below the wings.

5. The card edge connector as claimed in claim 4, wherein the main body further includes an embossment abutting against the constraining face in the longitudinal direction for stabilizing the guiding member in the housing.

6. The card edge connector as claimed in claim 1, wherein the constraining wall at an end of the housing forms only one constraining face facing toward the card receiving slot while the constraining wall at an inner position of the housing forms two opposite constraining faces away from each other toward the card receiving slot.

7. The card edge connector as claimed in claim 6, wherein the constraining wall at the end is associated with only one constraining face to confront only one guiding member, while the constraining wall at the inner position is associated with two opposite constraining faces to confront two guiding members, respectively.

8. The card edge connector as claimed in claim 7, wherein in one constraining wall located in the inner position, the free end regions of the two curved guiding sections of the two guiding members are separated from each other by a step in the longitudinal direction.

9. The card edge connector as claimed in claim 7, wherein in one constraining wall located in the inner position, the free end regions of the two curved guiding sections of the two guiding members intimately confront each other in the longitudinal direction.

10. The card edge connector as claimed in claim 1, wherein the contacts are integrally formed on corresponding insulators to form contact modules, and the contact modules are upwardly inserted respectively into corresponding spaces of the housing which are divided by the constraining walls.

11. A card edge connector comprising:

an insulative housing having a pair of side walls with a card receiving slot located therebetween in a transverse direction and extending along a longitudinal direction perpendicular to the transverse direction and communicating with an exterior in a vertical direction perpendicular to both the transverse direction and the longitudinal direction, and a plurality of constraining walls linked between the pair of side walls in the transverse direction, each constraining wall forming a step structure at a top end thereof and a vertically extending constraining face facing toward the card receiving slot;

a plurality of contacts disposed in the housing with contacting sections extending into the card receiving slot; and a plurality of metallic guiding members associating with the corresponding constraining walls, respectively; wherein each guiding member includes a planar main body attached upon the vertically extending constraining face, and an oblique resilient guiding section unitarily extending from an upper end of the main body with a free end region intimately positioned, in the vertical direction, upon a shoulder edge formed on the step structure so as to have the guiding section deformable in a space between the step structure and the vertically extending constraining face.

12. The card edge connector as claimed in claim 11, wherein the step structure includes two steps, and the shoulder edge is formed by one step located at a lower level than the other.

13. The card edge connector as claimed in claim 12, wherein the step located at an upper level further forms a vertical surface above the shoulder edge, and a tip of the free end region of the guiding member intimately confronts the vertical surface along the longitudinal direction.

14. The card edge connector as claimed in claim 11, wherein the main body of the guiding member includes a pair of wings on two lateral edges and neighboring the oblique resilient guiding section, and barbs on said two lateral edges below the wings.

15. The card edge connector as claimed in claim 14, wherein the main body further includes an embossment abutting against the constraining face in the longitudinal direction for stabilizing the guiding member in the housing.

16. The card edge connector as claimed in claim 15, wherein the constraining wall at an end of the housing forms only one constraining face facing toward the card receiving slot while the constraining wall at an inner position of the housing forms two opposite constraining faces away from each other toward the card receiving slot.

17. The card edge connector as claimed in claim 16, wherein the constraining wall at the end is associated with only one constraining face to confront only one guiding member, while the constraining wall at the inner position is associated with two opposite constraining faces to confront two guiding members, respectively.

18. The card edge connector as claimed in claim 17, wherein in one constraining wall located in the inner position, the free end regions of the two curved guiding sections of the two guiding members are separated from each other by a step in the longitudinal direction.

19. The card edge connector as claimed in claim 17, wherein in one constraining wall located in the inner position, the free end regions of the two curved guiding sections of the two guiding members intimately confront each other in the longitudinal direction.

20. The card edge connector as claimed in claim 11, wherein the contacts are integrally formed on corresponding insulators to form contact modules, and the contact modules are upwardly inserted respectively into corresponding spaces of the housing which are divided by the constraining walls.

* * * * *